US006026747A

United States Patent [19]

Carme et al.

[11] Patent Number: 6,026,747

[45] Date of Patent: Feb. 22, 2000

[54] AUTOMATIC PLATE-LOADING CYLINDER FOR MULTIPLE PRINTING MEMBERS

[75] Inventors: Lawrence J. Carme, Winchester, Mass.; Richard A. Williams, Hampstead; Douglas D. Fuller, Contoocook, both of N.H.

[73] Assignee: Presstek, Inc., Hudson, N.H.

[21] Appl. No.: 09/245,104

[22] Filed: Jan. 19, 1999

[51] Int. Cl.[7] ..... B41F 13/10; B41F 27/06; B41F 1/28; B41L 47/14

[52] U.S. Cl. ..... 101/415.1; 101/477; 101/418; 101/378; 101/382.1

[58] Field of Search ..... 101/415.1, 418, 101/477, 378, 382.1, 216

[56] References Cited

U.S. PATENT DOCUMENTS

| | | | |
|---|---|---|---|
| 414,680 | 11/1889 | Cottrell | 101/415.1 |
| 1,760,152 | 5/1930 | Lorentzen . | |
| 2,958,778 | 11/1960 | Miller et al. | 250/65 |
| 3,156,182 | 11/1964 | Ritzerfeld et al. | 101/142 |
| 3,588,242 | 6/1971 | Bertier et al. | 355/16 |
| 3,600,086 | 8/1971 | Cates et al. | 355/16 |
| 3,974,974 | 8/1976 | Nishikawa | 242/55 |
| 4,076,183 | 2/1978 | Kingsley | 242/67.3 |
| 4,076,410 | 2/1978 | Kono et al. | 355/16 |
| 4,231,652 | 11/1980 | Moser et al. | 355/3 DR |
| 4,239,375 | 12/1980 | Eisbein et al. | 355/16 |
| 4,395,946 | 8/1983 | Price | 101/152 |
| 4,477,180 | 10/1984 | Bustamante | 355/14 R |
| 5,110,669 | 5/1992 | May et al. | 430/54 |
| 5,164,992 | 11/1992 | Turk et al. | 382/2 |
| 5,355,795 | 10/1994 | Moss et al. | 101/141 |
| 5,413,043 | 5/1995 | Fuhrmann et al. | 101/415 |
| 5,432,864 | 7/1995 | Lu et al. | 382/118 |
| 5,435,242 | 7/1995 | Kusch et al. | 101/142 |
| 5,618,388 | 4/1997 | Seeser et al. | 204/192.12 |
| 5,622,111 | 4/1997 | Bachmeir et al. | 101/415.1 |
| 5,697,295 | 12/1997 | Schmid | 101/212 |
| 5,727,749 | 3/1998 | Pensavecchia et al. | 242/538.3 |

FOREIGN PATENT DOCUMENTS

| | | | |
|---|---|---|---|
| 0 512 549 B1 | 11/1992 | European Pat. Off. | B41C 1/10 |

*Primary Examiner*—Kimberly Asher
*Attorney, Agent, or Firm*—Cesari and McKenna, LLP

[57] ABSTRACT

Multiple winding mechanisms are disposed within a single cylinder, such as the plate cylinder of a printing press, and are actuable so as to pay out material across different cylinder segments. For example, the winding mechanisms may be differentially geared to cylinder rotation, such that rotation of the cylinder in a first direction advances material from a first winding mechanism across a first circumferential portion of the cylinder to a second winding mechanism; while rotation of the cylinder in the opposite direction advances material from the second winding mechanism across a second circumferential portion of the cylinder (which may, for example, be diametrically opposed to the first cylinder portion) to the first winding mechanism. Alternatively, material advancement may be achieved by means of a dedicated motor rather than mechanical coupling to cylinder rotation.

9 Claims, 3 Drawing Sheets

AUTOMATIC PLATE-LOADING CYLINDER FOR MULTIPLE PRINTING MEMBERS

BACKGROUND OF THE INVENTION

1. Field of the Invention

The present invention relates to digital printing apparatus and methods, and more particularly to an apparatus for continuously supplying lithographic printing material to the plate cylinder of a planographic printing press or a plate imager.

2. Description of the Related Art

Traditional techniques of introducing a printed image onto a recording material include letterpress printing, gravure printing and offset lithography. All of these printing methods require a plate, usually loaded onto a plate cylinder of a rotary press for efficiency, to transfer ink in the pattern of the image. In letterpress printing, the image pattern is represented on the plate in the form of raised areas that accept ink and transfer it onto the recording medium by impression. Gravure printing plates, in contrast, contain series of wells or indentations that accept ink for deposit onto the recording medium; excess ink must be removed from the plate by a doctor blade or similar device prior to contact between the plate and the recording medium.

In the case of offset lithography, the image is present on a plate or mat as a pattern of ink-accepting (oleophilic) and ink-repellent (oleophobic) surface areas. In a dry printing system, the plate is simply inked and the image transferred onto a recording medium; the plate first makes contact with a compliant intermediate surface called a blanket cylinder which, in turn, applies the image to the paper or other copying medium. In typical rotary press systems, the recording medium is attached to an impression cylinder, which brings it into contact with the blanket cylinder.

In a wet lithographic system, the non-image areas are hydrophilic, and the necessary ink-repellency is provided by an initial application of a dampening (or "fountain") solution to the plate prior to inking. The fountain solution prevents ink from adhering to the non-image areas, but does not affect the oleophilic character of the image areas.

The plates for an offset printing press are produced photographically or through digital imaging. Traditionally, plates have been affixed to the plate cylinders of the press by means of clamps and the like. More recent systems, however, eliminate the chore of removing and replacing spent plates by locating a continuous supply of imageable plate material within a cavity within the plate cylinder. Each time a printing job is completed, fresh plate material is advanced around the cylinder to replace the spent segment.

It is important, during press operation, to maintain a substantial tension along the plate material that surrounds the plate cylinder. This material experiences significant tangential force as a result of contact with the blanket cylinder, the force resulting primarily from slight differences in the rolling diameters of the mating cylindrical surfaces, which are in contact at sufficient pressure to compress the compliant blanket cylinder surface, and will alter the orientation of the plate or dislodge it completely unless the plate is held with adequate tension against the plate cylinder. Accordingly, a plate-material "payout" system must maintain strong contact between the plate material and the cylinder; at the same time, however, it must also allow sufficient relaxation to permit smooth supply and uptake of the material. U.S. Pat. Nos. 5,355,795 and 5,727,749 (the entire disclosures of which are hereby incorporated by reference) teach arrangements designed to accommodate the tensioning requirements of commercial printing systems.

Such systems, however, provide for only a single segment of plate material that is imaged, used to print copy, and replaced with fresh material drawn from inside the plate cylinder. Although a single segment of plate material may accept multiple images (e.g., to facilitate simultaneous printing of different jobs, or multiple pages of the same job), all must be discarded at the same time as the material is advanced.

DESCRIPTION OF THE INVENTION

BRIEF SUMMARY OF THE INVENTION

In accordance with the invention, multiple winding mechanisms are disposed within a single cylinder, and are selectively actuable so as to pay out material across different cylinder segments. For example, the winding mechanisms may be differently geared to cylinder rotation, such that rotation of the cylinder in a first direction advances material from a first winding mechanism across a first circumferential portion of the cylinder to a second winding mechanism; while rotation of the cylinder in the opposite direction advances material from the second winding mechanism across a second circumferential portion of the cylinder (which may, for example, be diametrically opposed to the first cylinder portion) to the first winding mechanism. Alternatively, material advancement may be achieved by means of one or more dedicated motors rather than mechanical coupling to cylinder rotation.

In accordance with the invention, therefore, at least two winding mechanisms are distributed around a cylinder. Each winding mechanism includes rotatable supply and take-up spools within the cylinder, and means for winding material onto the take-up spool. The supply spool of each winding mechanism is configured to dispense recording material over a travel path extending around the cylinder to the take-up spool of an adjacent winding mechanism. Accordingly, material may be advanced from a selected winding mechanism (with the remainder inactive).

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
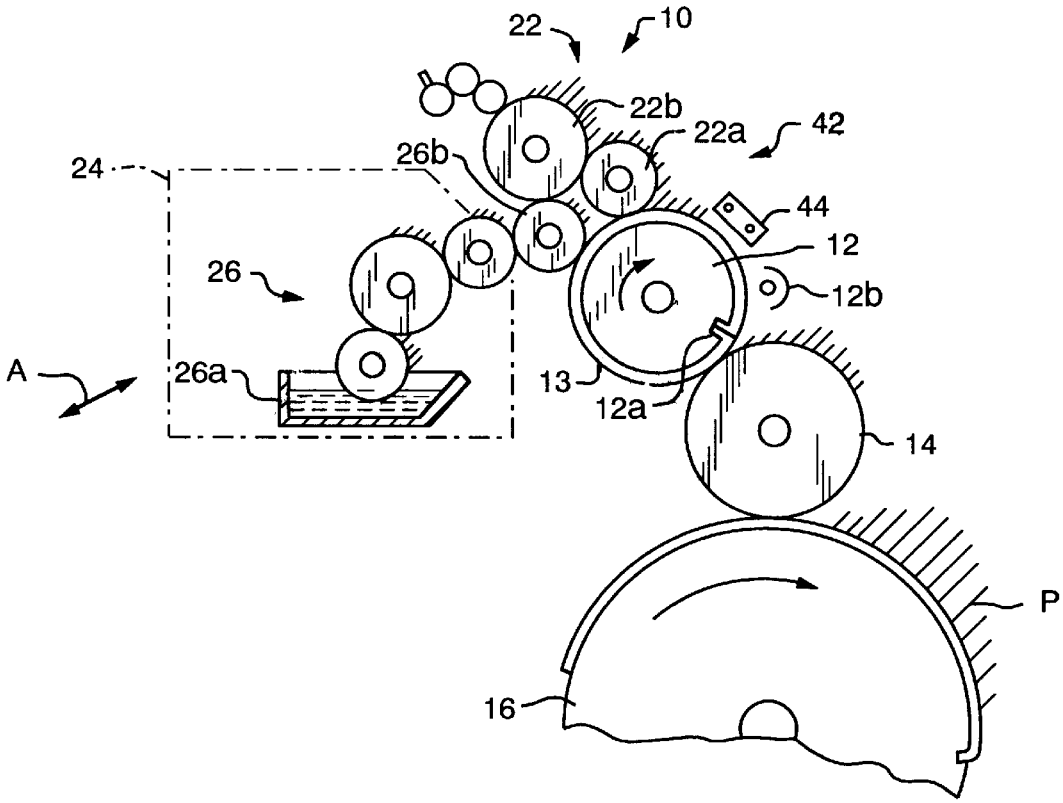
FIG. 1 (PRIOR ART)
FIG. 1 is a partial diagrammatic view of a prior art offset press incorporating a lithographic printing plate.

The present invention is useful in conjunction with any type of mechanism that advances sheet or web material around a cylinder. In an exemplary embodiment, the invention is utilized in an on-press imaging environment, such as that illustrated in FIGS. 1 and 2. In accordance therewith, a plate cylinder 12 is rotatably supported by a press frame 10*a* and rotated by a standard electric motor 34 or other conventional means. The angular position of cylinder 12 is monitored by conventional means such as a shaft encoder 36 and a detector 36*a*; the encoder 36 rotates with the motor armature.

Also supported on frame 10*a* adjacent to plate cylinder 12 is a writing head assembly shown generally at 42. This assembly comprises a lead screw 42*a* whose opposite ends are rotatably supported in the press frame 10*a*, which frame also supports the opposite ends of a guide bar 42*b* spaced parallel to lead screw 42*a*. Mounted for movement along the lead screw and guide bar is a carriage 44. When the lead screw is rotated by a stepper motor 46, carriage 44 is moved axially with respect to plate cylinder 12.

The cylinder drive motor 34 and stepper motor 46 are operated in synchronism by a press controller (not shown), which also receives signals from detector 36a so that, as the plate cylinder rotates, the carriage 44 scans axially along the cylinder with the controller "knowing" the instantaneous relative position of the carriage and cylinder at any given moment. Suitable control circuitry to accomplish this is set forth, for example, in U.S. Pat. No. 5,174,205. Other control circuitry, such as that described in U.S. Pat. No. 4,911,075, directs the activity of a writing head contained within carriage 44, causing the application at selected points in the scan of imaging pulses (e.g., laser discharges, spark or plasma discharches, or ink jets) directed toward the surface of plate 13. The discharges occur in response to picture signals representing the image to be impressed on the plate, and cause ablation or other surface modification that changes the affinity of the plate for ink and/or water (depending on whether the press is to print in a "dry" or "wet" mode).

Figure 2:
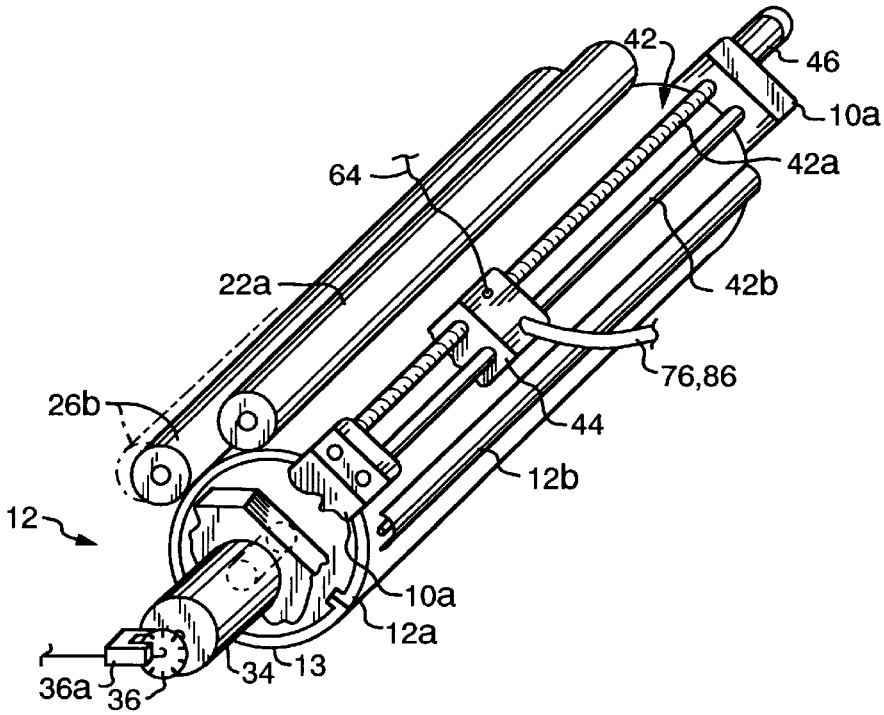
FIG. 2 (PRIOR ART)
FIG. 2 is an isometric view on a larger scale showing in greater detail the prior art plate cylinder portion of the FIG. 1 press.
Figure 3:
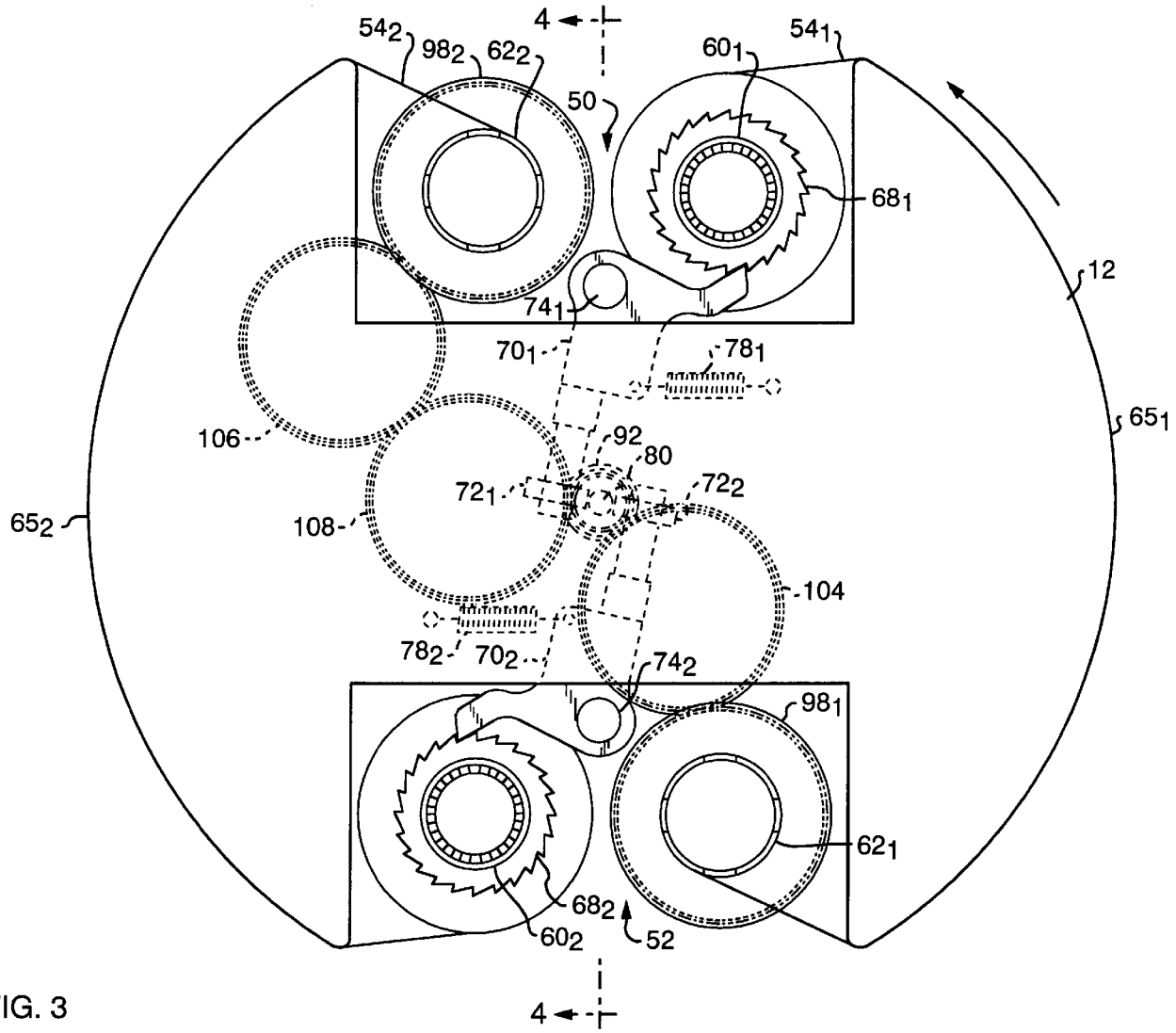
FIG. 3 is an end view of a plate cylinder in accordance with the present invention, with the external drive components omitted for clarity.
Figure 4:
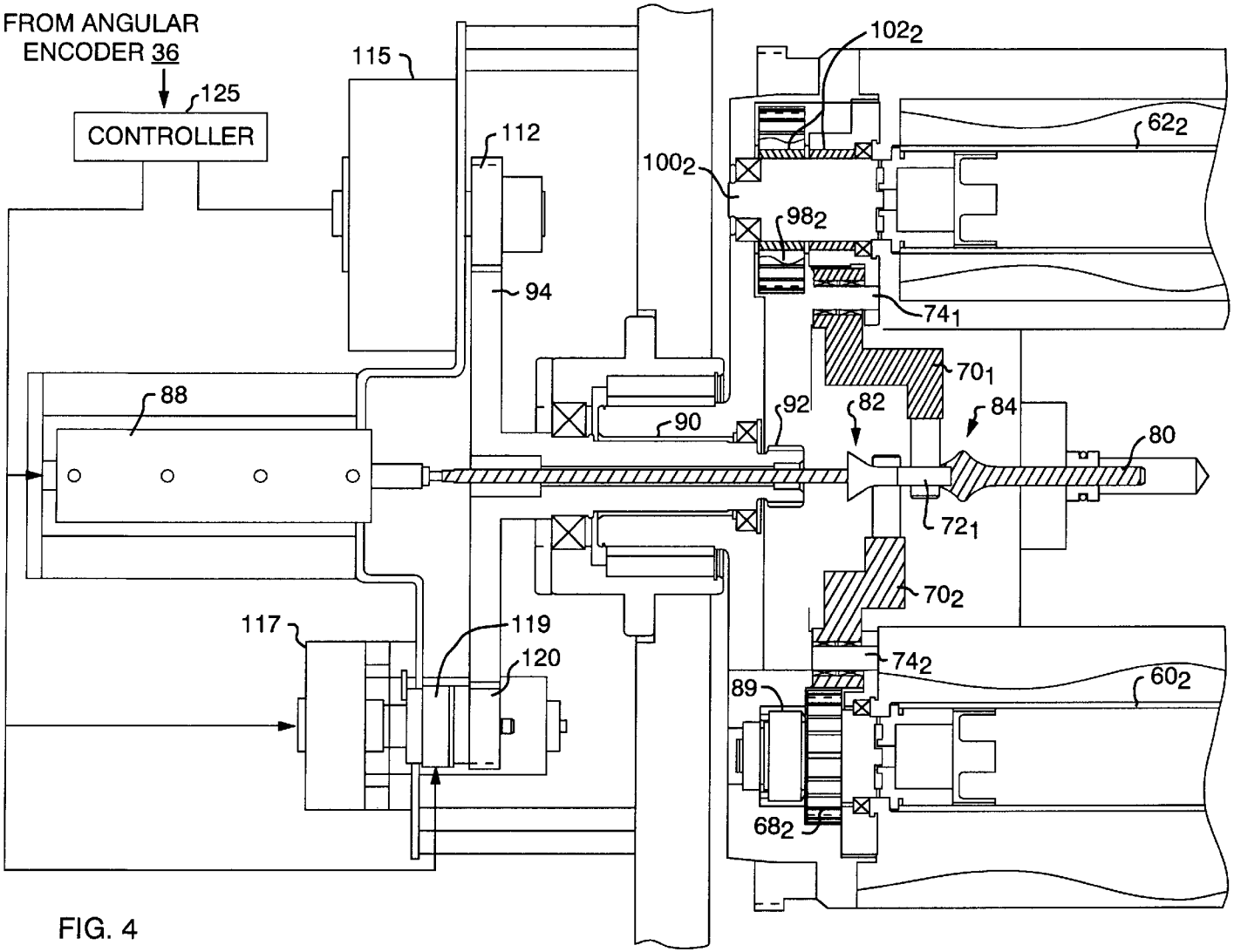
FIG. 4 is a sectional view of the plate cylinder shown in FIG. 3, taken along the line 4—4.

In accordance with the present invention, the press configuration shown in FIGS. 1 and 2 is adapted to accommodate multiple continuous supplies of plate material on a single plate cylinder. FIGS. 3 and 4 illustrate the components of the present plate-material supply and take-up apparatus, adapted for a dual-plate configuration with diametrically opposed printing segments. It should be recognized, however, that this configuration is exemplary only; the present invention can include more than two mechanisms distributed evenly or otherwise around the cylinder.

With reference to FIG. 3, the plate-material supply and take-up components are located in a pair of opposed cavities 50, 52 within cylinder 12. A first segment $\mathbf{54}_1$ of plate (or other recording) material wraps around a portion of the surface of cylinder 12, extending from a supply spool $\mathbf{60}_1$ rotatable within cavity 50 to a take-up spool $\mathbf{62}_1$ rotatable within cavity 52. Accordingly, rotation of take-up spool $\mathbf{62}_1$ causes supply spool $\mathbf{60}_1$ to dispense recording material over a travel path extending around a portion $\mathbf{65}_1$ of cylinder 12, from cavity 50 to cavity 52.

A second segment $\mathbf{54}_2$ of plate material wraps around an opposed portion of the surface of cylinder 12, extending from a supply spool $\mathbf{60}_2$ rotatable within cavity 52 to a take-up spool $\mathbf{62}_2$ rotatable within cavity 50. The travel path of segment $\mathbf{54}_2$ extends around a portion $\mathbf{65}_2$ of cylinder 12, from cavity 52 to cavity 50. The spools may be mounted within cylinder 12 in any number of suitable manners. These include placement within a frame or cassette, as described in the '795 patent, or installed and removed individually as set forth in the '749 patent.

Furthermore, the surface of cylinder 12 may have a texture that allows plate material to pass easily thereover as it is advanced, but which also prevents slippage of the plate material when stationary. We have found that a tungsten carbide coating, applied by plasma spraying to a moderate degree of roughness, fulfills these criteria satisfactorily.

Each supply spool $\mathbf{60}_1$, $\mathbf{60}_2$ contains a respective ratchet $\mathbf{68}_1$, $\mathbf{68}_2$. A pair of pawls $\mathbf{70}_1$, $\mathbf{70}_2$, each having a respective cam follower $\mathbf{72}_1$, $\mathbf{72}_2$ extending therefrom, are rotatable about respective pivots $\mathbf{74}_1$, $\mathbf{74}_2$. The tooth of each pawl $\mathbf{70}_1$, $\mathbf{70}_2$ engages the corresponding ratchet $\mathbf{68}_1$, $\mathbf{68}_2$. A pawl spring $\mathbf{78}_1$, $\mathbf{78}_2$, extending between the arm of pawl $\mathbf{70}_1$, $\mathbf{70}_2$ and a point within plate cylinder 12 that remains stationary with respect to pawl $\mathbf{70}_1$, $\mathbf{70}_2$, urges the pawl against the corresponding ratchet $\mathbf{68}_1$, $\mathbf{68}_2$.

With reference to FIG. 4, the movement of pawls 70 is controlled by a linear cam shaft 80 having a pair of camming surfaces 82, 84. Cam shaft 80, in turn, is reciprocated by a three-position pneumatic cylinder 88. In the middle position, illustrated in the figure, neither cam follower 72 is displaced, so that both pawls 70 remain engaged to their respective ratchets 68. When shaft 80 is advanced by cylinder 88, cam surface 82 displaces cam follower $\mathbf{72}_2$ (see FIG. 3), releasing pawl $\mathbf{70}_2$ from engagement with ratchet $\mathbf{68}_2$; when shaft 80 is retracted, cam surface 84 displaces cam follower $\mathbf{72}_1$ in an analogous fashion (best shown in FIG. 4). When either pawl 70 disengages its corresponding ratchet 68, the associated supply spool 62 is free to rotate and dispense fresh plate material. A friction brake 89 may be associated with each supply spool 62 to provide some resistance to rotation, thereby preventing excessive acceleration.

Also as shown in FIG. 4, a central shaft 90 coaxially surrounds cam shaft 80, which is free to slide therein. The inner end of central shaft 90 terminates in a central gear 92, while the outer end of central shaft 90 terminates in a drive gear 94. Each take-up spool 62 is coupled to a take-up gear 98 by means of a shaft 100, which, in turn, passes through a one-way clutch 102 (see FIG. 4, which illustrates shaft $\mathbf{100}_2$ and clutch $\mathbf{102}_2$). With reference to FIG. 3, take-up gear $\mathbf{98}_1$ meshes with an intermediate gear (or an odd number of intermediate gears) 104, which itself meshes with central gear 92. Take-up gear $\mathbf{98}_2$ can mesh directly with central gear 92 or, as shown, by means of a pair (or other even number) of intermediate gears 106, 108, the latter of which meshes with central gear 92. (The intermediate gears are omitted from FIG. 4 for clarity.) As will become clear, different numbers of intermediate gears are used to facilitate independent control of the different winding mechanisms by opposite rotations of cylinder 12.

Drive gear 94 meshes with a brake gear 112, which extends from an electrically controlled (e.g., magnetic particle) brake 115. An optional manual drive motor 117 terminates in a motor gear 120, which meshes with drive gear 94.

Operation of the plate-winding mechanisms of the present invention is as follows. Ordinarily, central shaft 90 rotates with cylinder 12 and gears 98, 104, 106, 108 remain stationary with respect to central shaft 90; drive gear 94 rotates with respect to brake gear 112, which offers no resistance thereto. To cause plate material to be wound onto, for example, take-up spool $\mathbf{62}_1$, the operator notifies a controller 125, which actuates cylinder 88 to cause retraction of cam shaft 80, thereby disengaging pawl $\mathbf{70}_1$ and releasing supply spool $\mathbf{60}_1$. Controller 125 also engages brake 115. With brake 115 engaged, rotation of central shaft 90 and central gear 92 is arrested. Cylinder 12 continues to rotate, however; assuming counterclockwise rotation (as indicated by the arrow in FIG. 3) and with central gear 92 now rendered stationary, rotation of cylinder 12 causes intermediate gear 104 to rotate about shaft gear 90 as a "planetary" gear, turning take-up gear $\mathbf{98}_1$ in a clockwise direction to draw plate material from supply spool $\mathbf{60}_1$ (itself now free to rotate due to disengagement of pawl $\mathbf{70}_1$). Reverse rotation of take-up spool $\mathbf{62}_1$, is prevented by the one-way clutch. Because of the even number of intermediate gears coupling central gear 90 to take-up gear $\mathbf{98}_2$, the rotation of the other take-up spool $\mathbf{62}_2$, if permitted, would be such as to relieve tension rather than take up plate material. Tension is maintained, however, by virtue of one-way clutch $\mathbf{102}_2$, which allows take-up gear $\mathbf{98}_2$ to rotate without affecting take-up spool $\mathbf{62}_2$.

Controller 125 monitors rotation of cylinder 12 by means of angular encoder 36. When cylinder 12 has rotated, with central gear 92 stationary, a sufficient amount to withdraw the appropriate length of plate material from supply spool $\mathbf{60}_1$, controller 125 causes air cylinder 88 to extend cam shaft 80 back into the middle position, re-engaging pawl $\mathbf{70}_1$ and ratchet $\mathbf{68}_1$ and, consequently, locking supply spool $\mathbf{60}_1$. Brake 115, however, remains active, preventing rotation of gears 112, 94, and 92, so that intermediate gear 104 continues to turn about central gear 92 as cylinder 12 rotates. As additional plate material is wound onto take-up spool $\mathbf{62}_1$, the tension in the plate material along the portion $\mathbf{65}_1$ of cylinder 12 increases. This augments the torque on gear 94 and, consequently, on brake 115 as well. The maximum allowed torque on brake 115 may be set by the user (e.g., in the case of a current-limited brake, by the applied electrical current) or computed by controller 125 (e.g., in accordance with the '749 patent). When this torque is exceeded, brake 115 slips and gear 94 begins to rotate. This results in cutoff of power to brake 115. Unimpeded by brake 115, central shaft 90 and gear 92 are then free once again to rotate. The tension established along the withdrawn plate material is maintained by the one-way clutch (which prevents material from leaving take-up spool $\mathbf{98}_1$) and ratchet $\mathbf{68}_1$ and pawl $\mathbf{70}_1$ (which prevent material from being drawn off supply spool $\mathbf{68}_1$).

It is not necessary to immediately detect the point at which brake 115 slips. Since some rotation of gear 112 past the point of brake slippage is harmless, a simple timing circuit (tied, for example, to actuation of air cylinder 88) can be used to cut power to brake 125 when it can be safely assumed that it has slipped. Alternatively, if more precision is desired, a detector gear (not shown) can be utilized; this is gear meshes with gear 94 and is also coupled to a resettable relay that cuts power to brake 115 as soon as the detector gear begins to rotate, reflecting slippage of brake 115.

It is also possible to add precision to the manner in which plate material is dispensed. In general, the amount of material actually paid out during a cycle is equal to the length of the area to be imaged plus a gap of at least about 0.5 inch, which ensures that the new image will not overlap the old image. For example, some material may be wound by a take-up spool 62 before any material is actually drawn from the corresponding supply spool 60; unless slightly more material is taken up than would be necessary in a system devoid of slackness, the result could be insufficient payout. To avoid the need for this additional material, means can be introduced to monitor supply spools 60 or material wrapped therearound to detect the onset of rotation (and actual payout), when it is appropriate to begin monitoring the rotation of cylinder 12—i.e., when the advancement cycle truly commences. This detection means can be, for example, a gear associated with each the supply spools or a spring-loaded rubber wheel riding on the surface of the undispensed plate material, which is configured to signal controller 125 as soon as it begins to turn. In designs utilizing one or more motors 117, an encoder can be associated with each gear 120.

To advance material from supply spool $\mathbf{60}_2$ to take-up spool $\mathbf{62}_2$, the foregoing procedure is implemented with cylinder 12 rotating in the opposite direction.

As an alternative to the use of cylinder rotation to advance plate material, one or more manual drive motors 117 with associated magnetic clutches 119 may be employed instead. In this mode of operation, rotation of cylinder 12 is stopped, and controller 125 operates air cylinder 88 to disengage the appropriate pawl 70. Controller 125 then activates motor 117 and the associated clutch 119, turning gear 94 (and, therefore, central gear 92) in the appropriate direction to dispense plate material from the selected supply spool. Motor 117 turns until the appropriate amount of material has been withdrawn, at which point controller 125 turns off the clutch 119 and causes air cylinder 88 to return cam shaft 80 to the middle position, thereby re-engaging the pawl. Controller 125 once again activates clutch 119 to tension the material, the degree of tension being controlled by the current supplied to the clutch, following which the motor and clutch are both deactivated. It should be noted that a single reversible motor 117 can be used to drive gear 94 in either direction, or separate motors 117, each rotatable in opposite directions, can be employed instead.

As noted earlier, the foregoing arrangement is exemplary only. It is possible, for example, to have more than two winding mechanisms (although two opposed mechanisms as illustrated, with identical amounts of material simultaneously advanced, advantageously maintains balance within the cylinder). For example, multiple mechanisms may be distributed around the circumference of a large plate cylinder with different sets of axially displaced gear trains. Advancement or retraction of central gear 92 determines the gear train (i.e., the set of intermediate and take-up gears) engaged by central gear 92, and therefore the mechanism (or mechanisms) subject to control. Once again, each axial position can govern two mechanisms with odd and even numbers of intermediate gears, so that a different mechanism is addressed depending on the direction of rotation of cylinder 12.

It will therefore be seen that we have developed a reliable and convenient mechanism for dispensing and receiving material that wraps around a cylinder, and which is especially suited to lithographic printing systems. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. Apparatus for winding a recording material onto a cylinder adapted for rotation about a longitudinal axis, the apparatus comprising:

a. distributed around the cylinder, at least two winding mechanisms, each winding mechanism including (i) first and second rotatable spools within the cylinder, (ii) means for winding material onto the second spool, the first spool of each winding mechanism being configured to dispense a rolled supply of recording material over a travel path extending around the cylinder to the second spool of an adjacent winding mechanism, the second spool of each winding mechanism being configured to permit winding of dispensed recording material therearound, and (iii) tensioning means comprising means for preventing reverse rotation of the second spool, means for releasably locking the first spool, and means for establishing a predetermined amount of tension across the travel path with the first spool locked; and b. means for causing advancement of a predetermined amount of untensioned material from a selected winding mechanism onto the second spool of an adjacent winding mechanism with the first-spool locking mechanism of the selected winding mechanism released.

2. The apparatus of claim 1 wherein the winding means comprises means for coupling movement of the recording material along a travel path to rotation of the cylinder.

3. The apparatus of claim 1 wherein each winding mechanism further comprises:

a. means for causing rotation of the cylinder to (i) draw material from the first spool around the cylinder into an adjacent winding mechanism, or (ii) draw material from an adjacent winding mechanism around the cylinder onto the second spool; and b. means for monitoring the amount of plate material dispensed from the first spool and, upon dispensation of a predetermined amount of material, re-engaging the locking means, thereby re-establishing the predetermined amount of tension along the material originating with the first spool and wrapped around the cylinder.

4. The apparatus of claim 3 wherein rotation of the cylinder in a first direction causes material to be drawn from the first spool around the cylinder into an adjacent winding mechanism, and rotation of the cylinder in a second direction causes material to be drawn from an adjacent winding mechanism around the cylinder onto the second spool.

5. The apparatus of claim 4 further comprising a selectably breakable center gear, the first spool of a first winding mechanism being geared to the center gear by an even number of gears, the first spool of a second winding mechanism being geared to the center gear by an odd number of gears.

6. The apparatus of claim 3 including first and second adjacent winding mechanisms, the locking means of each mechanism comprising a pawl having a cam follower, the means for selectably disengaging the locking means comprising:

a. a cam shaft configured for reciprocation, the cam shaft having two camming surfaces axially displaced for independent interaction with one of the cam followers; and b. means for advancing or retracting the cam shaft so as to displace a selected pawl without affecting the other pawl, thereby unlocking a selected first spool.

7. The apparatus of claim 1 wherein each winding mechanism further comprises:

a. means for causing rotation of the cylinder to (i) draw material from the first spool around the cylinder into an adjacent winding mechanism, and simultaneously (ii) draw material from an adjacent winding mechanism around the cylinder onto the second spool; and b. means for monitoring the amount of plate material dispensed from the first spool and, upon dispensation of a predetermined amount of material, re-engaging the locking means, thereby re-establishing the predetermined amount of tension along the material originating with the first spool and wrapped around the cylinder.

8. The apparatus of claim 1 wherein there are two diametrically opposed winding mechanisms.

9. The apparatus of claim 1 futher comprises:

a. a center gear, the first spool of a first winding mechanism being geared to the center gear by an even number of gears, the first spool of a second winding mechanism being geared to the center gear by an odd number of gears; and b. means for monitoring the amount of plate material dispensed from each first spool and, upon dispensation of a predetermined amount of material, causing the motor to re-establish the predetermined amount of tension along the material wrapped around the cylinder, wherein said means for causing advancement comprises at least one motor for (i) causing rotation of the center gear in a first direction to draw material from the first spool of a first winding mechanism around the cylinder into a second winding mechanism, or (ii) causing rotation of the center gear in a second direction to draw material from the first spool of the second winding mechanism around the cylinder into the first winding mechanism.

* * * * *